US011198546B2

(12) United States Patent
Guery et al.

(10) Patent No.: US 11,198,546 B2
(45) Date of Patent: Dec. 14, 2021

(54) CARTRIDGE TO DISPENSE A PRODUCT IN A CONTAINER

(71) Applicant: BNOVA, Wierde (BE)

(72) Inventors: Jean-Claude Guery, Wierde (BE); Corinne Herlin, Strasbourg (FR)

(73) Assignee: BNOVA

( * ) Notice: Subject to any disclaimer, the term of this patent is extended or adjusted under 35 U.S.C. 154(b) by 130 days.

(21) Appl. No.: 16/481,310

(22) PCT Filed: Jan. 25, 2018

(86) PCT No.: PCT/EP2018/051787
§ 371 (c)(1),
(2) Date: Jul. 26, 2019

(87) PCT Pub. No.: WO2018/138186
PCT Pub. Date: Aug. 2, 2018

(65) Prior Publication Data

US 2020/0002066 A1 Jan. 2, 2020

(30) Foreign Application Priority Data

Jan. 26, 2017 (CN) ..... 201710057279.0

(51) Int. Cl.
*B65D 51/20* (2006.01)
*B65D 51/28* (2006.01)
(Continued)

(52) U.S. Cl.
CPC ..... *B65D 51/285* (2013.01); *B65D 41/3423* (2013.01); *B65D 53/02* (2013.01);
(Continued)

(58) Field of Classification Search
CPC ..... B65D 41/3423; B65D 51/285; B65D 51/2807; B65D 53/02; B65D 2251/0015;
(Continued)

(56) References Cited

U.S. PATENT DOCUMENTS 4,195,730 A * 4/1980 Hunt ..... B65D 51/2814 206/221
4,386,696 A * 6/1983 Goncalves ..... B65D 51/2871 206/221
(Continued)

OTHER PUBLICATIONS

International Search Report dated Mar. 21, 2018.

*Primary Examiner* — Gideon R Weinerth
(74) *Attorney, Agent, or Firm* — Fresh IP PLC; Clifford D. Hyra; Aubrey Y. Chen

(57) ABSTRACT

A cartridge (1) which is suitable to cooperate with the neck (3) of a container (5) in order to allow a product contained in the cartridge (1) to flow out into said container (5), said cartridge (1) including at least one reservoir (7); moveable sealing means (13) to close the opening (9) of the reservoir (7), and a socket (23) wherein the moveable sealing means (13) comprises at least one ring (19, 21) configured to cooperate with the neck (3) of the container (5) in order to allow the moveable sealing means (13) to slide along the lower wall (11) of the reservoir (7) by a pressure exerted on said ring (19, 21) by the neck (3) of the container (5) causing the opening of the one or more flaps (17) and further wherein at least one ring (19, 21) of the moveable sealing means (13) comprises holding lugs (25) configured to cooperate with an internal relief (27) of the socket (23) in order to maintain the moveable sealing means (13) in position inside the socket (23), closing the opening (9) of the reservoir (7).

6 Claims, 3 Drawing Sheets

(51) Int. Cl.
*B65D 25/08* (2006.01)
*B65D 53/02* (2006.01)
*B65D 41/34* (2006.01)

(52) U.S. Cl.
CPC ..... *B65D 51/2814* (2013.01); *B65D 51/2892* (2013.01); *B65D 2251/009* (2013.01); *B65D 2251/0015* (2013.01); *Y10S 215/08* (2013.01)

(58) Field of Classification Search
CPC ..... B65D 2251/009; B65D 2251/02; B65D 2251/023; B65D 51/2814; B65D 51/2835; B65D 5/747; B65D 5/748; B65D 5/749; B65D 51/2864; B65D 51/2878; B65D 51/2892; B65D 51/2821; Y10T 29/4984; Y10S 215/08
USPC .... 206/222, 219, 221; 215/250, 258, DIG. 8
See application file for complete search history.

(56) References Cited

U.S. PATENT DOCUMENTS 4,793,475 A * 12/1988 Itzel ..... B65D 81/3222 206/221
5,292,025 A * 3/1994 Dubreul ..... B65D 51/222 220/278
5,944,175 A * 8/1999 Albisetti ..... B65D 81/3211 206/221
6,148,996 A * 11/2000 Morini ..... B65D 51/285 206/222
6,149,866 A * 11/2000 Luotola ..... B65D 51/2871 422/401
6,840,373 B2 * 1/2005 Gibler ..... B65D 51/2842 206/219
7,347,322 B2 * 3/2008 Cho ..... B65D 51/2835 206/222
7,635,012 B2 * 12/2009 Johns ..... B65D 51/2814 141/112
7,748,550 B2 * 7/2010 Cho ..... B65D 51/285 215/228
8,387,786 B2 * 3/2013 Fontana ..... B65D 51/2892 206/221
9,617,050 B2 * 4/2017 Dreyer ..... B65D 51/2892
10,086,980 B2 * 10/2018 Isogai ..... B65D 47/123
10,479,571 B2 * 11/2019 Lanagan ..... B65D 51/2885
2003/0213709 A1 * 11/2003 Gibler ..... B65D 51/2842 206/219
2005/0161348 A1 7/2005 Morini
2005/0211579 A1 * 9/2005 Makita ..... B65D 51/2842 206/219
2006/0076353 A1 * 4/2006 Wu ..... B65D 51/2864 220/521
2007/0045134 A1 * 3/2007 Dvorak ..... B65D 51/2835 206/222
2008/0093326 A1 * 4/2008 Cho ..... B65D 51/285 215/228
2008/0197100 A1 * 8/2008 Faulconnier ..... B65D 51/18 215/250
2008/0202949 A1 * 8/2008 Morini ..... B65D 51/285 206/219
2009/0205506 A1 * 8/2009 Lin ..... B65D 51/2878 99/323
2010/0059394 A1 * 3/2010 Fontana ..... B65D 51/285 206/222
2010/0116773 A1 * 5/2010 Wu ..... B65D 51/2864 215/252
2013/0008808 A1 * 1/2013 Lee ..... B65D 51/2892 206/221
2013/0105433 A1 * 5/2013 Chen ..... B65D 51/285 215/227
2014/0048507 A1 * 2/2014 Brambilla ..... B65D 51/285 215/257
2014/0305817 A1 10/2014 Guery et al.
2015/0217914 A1 * 8/2015 Burgess ..... B65D 51/2835 220/521
2016/0288967 A1 * 10/2016 Isogai ..... B65D 47/36
2018/0044079 A1 * 2/2018 van de Grift et al. ..... B65D 51/2835
2018/0208372 A1 * 7/2018 Rovelli ..... B65D 81/266
2020/0002066 A1 * 1/2020 Guery ..... B65D 51/285
2021/0206548 A1 * 7/2021 Pilotti ..... B65D 51/285

* cited by examiner

CARTRIDGE TO DISPENSE A PRODUCT IN A CONTAINER

This application is a National Phase entry of International Application No. PCT/EP2018/051787 under § 371 and claims the benefit of Chinese patent application No. 201710057279.0, filed Jan. 26, 2017, which is hereby incorporated by reference in its entirety.

TECHNICAL SCOPE

This disclosure relates to the area of cartridges adapted to dispense a product such as a liquid or a powder in a container containing a liquid product. More particularly, the disclosure relates to a cartridge which can be arranged on a container allowing a solution to be prepared in situ.

BACKGROUND

Food or non-food formulations in the form of powder or fluid are very widespread. Said formulations must be stored and prepared under strict conditions of hygiene or safety. Formulations in the form of powder or fluid can be arranged in packaging separated from the contents in which they will subsequently be diluted or dispersed. For example, the formulation can be arranged in sealed packaging, said packaging being opened in order to release the powder or the fluid into a container such as a bottle. Said handling is generally carried out by the end user and implies a risk of contamination of the water or the formulation.

Devices or containers comprising an independent reservoir for storing a formulation are known. For example, US2011/0226770 describes a closure which is closed at its outer end and allows a fluid product to be distributed in a bottle. Problems may arise when the cartridge needs to cooperate with the neck of the container, in particular when the neck of the containers show different formats, such as different diameters or different lengths.

Therefore there is a need for a device which is suitable to be mounted on a container and allows a solution to be prepared in situ by mixing a product contained in the device, for example a fluid or a powder, with a liquid contained in the container, and which solves, at least in part, one or several of the aforesaid problems of the known devices.

SUMMARY

It is an object of some embodiments of the present invention to provide a cartridge configured to dispense a product in a container with opening means that are configured to cooperate with the neck of containers wherein said necks have different formats.

Thus, the invention in some embodiments provides a cartridge which is suitable to cooperate with the neck of a container in order to allow a product contained in the cartridge to flow out into said container, said cartridge including:

- a reservoir which is suitable to contain the said product, said reservoir having a lower opening on its lower wall to transfer said product from the reservoir into the container;
- movable sealing means to close the opening of the reservoir, the moveable sealing means comprising a cylindrical body and one or more flaps closing the lower aperture of the cylindrical body, wherein said cylindrical body is dimensioned to surround the lower wall of the reservoir and to slide along it between a closing and an opening position, wherein in the opening position the one or more flaps are opened by the pressure exerted by the lower wall of the reservoir on said flaps;
- a socket arranged to surround both the lower wall of the reservoir and the moveable sealing means;

the cartridge being remarkable in that the moveable sealing means further comprises at least one ring, wherein the ring or one of the rings is configured to cooperate with the neck of the container in order to allow the moveable sealing means to slide along the lower wall of the reservoir by the pressure exerted on said ring by the neck of the container causing the opening of the one or more flaps, and in that at least one ring of the moveable sealing means comprises holding lugs configured to cooperate with an internal relief of the socket in order to maintain the moveable sealing means in position inside the socket, closing the opening of the reservoir.

With preference, the socket is integral with the reservoir.

With preference, the one or more flaps are linked to the ring configured to cooperate with the neck of the container. Preferably, the movable sealing means comprises two rings distributed along the cylindrical body in order to show a lower ring and an upper ring, wherein the one or more flaps are linked to the lower ring.

In a preferred embodiment of the invention, the movable sealing means comprises two rings distributed along the cylindrical body in order to show a lower ring and an upper ring, wherein the lower ring is the one arranged to cooperate with the neck of the container. This arrangement allows the cartridge to be opened with a reduced stroke of the movable means when sliding along the wall of the reservoir.

In an embodiment, the internal relief of the socket is an internal thread or is one or more hoops. In the embodiment wherein the internal relief is an internal thread, the cartridge can be screwed on the neck of the container and the internal thread also cooperate with the holding lugs to maintain the moveable sealing means in the closing position. In the embodiment wherein the internal relief is one or more hoops, the one or more hoops cooperate with the holding lugs to clip the moveable sealing means in the closing position.

In an embodiment, the movable sealing means is provided with clipping means in order to be fixed on the reservoir wall.

In an embodiment, the socket shows a lower aperture dimensioned to receive the neck of the container, wherein the lower aperture has an internal diameter higher than the external diameter of the ring, or of at least one of the rings of the movable sealing means.

Preferably, the internal relief of the socket is one or more hoops and the ring or one of the rings that is configured to cooperate with the neck of the container has an outer diameter of at least twice the diameter of the opening of the reservoir. Such configuration allows the cartridge to cooperate with containers having necks of different diameters.

Preferably, the reservoir forms a tube such that the lower opening of said reservoir is an aperture of the same diameter than said reservoir. Thus, the reservoir is a tube opened on one side.

Preferably, the movable sealing means comprises two rings distributed along the cylindrical body so as to show a lower ring and a upper ring, wherein the upper ring of the movable sealing means comprises holding lugs configured to cooperate with an internal thread of the socket in order to maintain the moveable sealing means in position inside the socket, closing the opening of the reservoir. When the socket comprises an internal thread the cartridge is suitable to be mounted on the neck of a reservoir.

In a variant of the invention, the movable sealing means comprise two rings distributed along the cylindrical body so as to show a lower ring and an upper ring, the upper ring of the movable sealing means comprises holding lugs configured to cooperate with one or more internal hoops of the socket, in order to maintain the moveable sealing means in position inside the socket, closing the opening of the reservoir. In such arrangement, the one or more internal hoops are clipping means cooperating with the holding lugs to clip the moveable sealing means on a closing position of the reservoir.

Optionally, the lower wall of the reservoir shows a bevelled or twisted shape so that its periphery shows a variation in height from the top of the reservoir, wherein the periphery is intended to come into contact with the one or more flaps.

In an embodiment, the movable sealing means comprises a plurality of flaps, each flap having at least one side in common with an adjacent flap and whose distal ends form a point or line of junction to said plurality of flaps and the lower wall of the reservoir will exert a pressure on the proximal end of the flaps so as to open them when the movable sealing means slide along said lower wall.

In another embodiment, the moveable sealing means comprise a single flap, wherein the flap is connected to the lower ring by a frangible zone defining a perimeter of rupture, suitable to be ruptured by a pressure exerted by the lower wall of the reservoir so as to open it when the movable means slide along said lower wall, and the flap and the lower ring are made of the same material, the frangible zone being obtained by reducing the thickness of the wall of the flap. Preferably, the flap is further connected to the lower ring by at least one hinge in a form of a leg showing a thickness portion.

DETAILED DESCRIPTION OF EMBODIMENTS OF THE INVENTION

The present invention is defined by the accompanying independent claims. Preferred embodiments are defined in the dependent claims.

Figure 1:
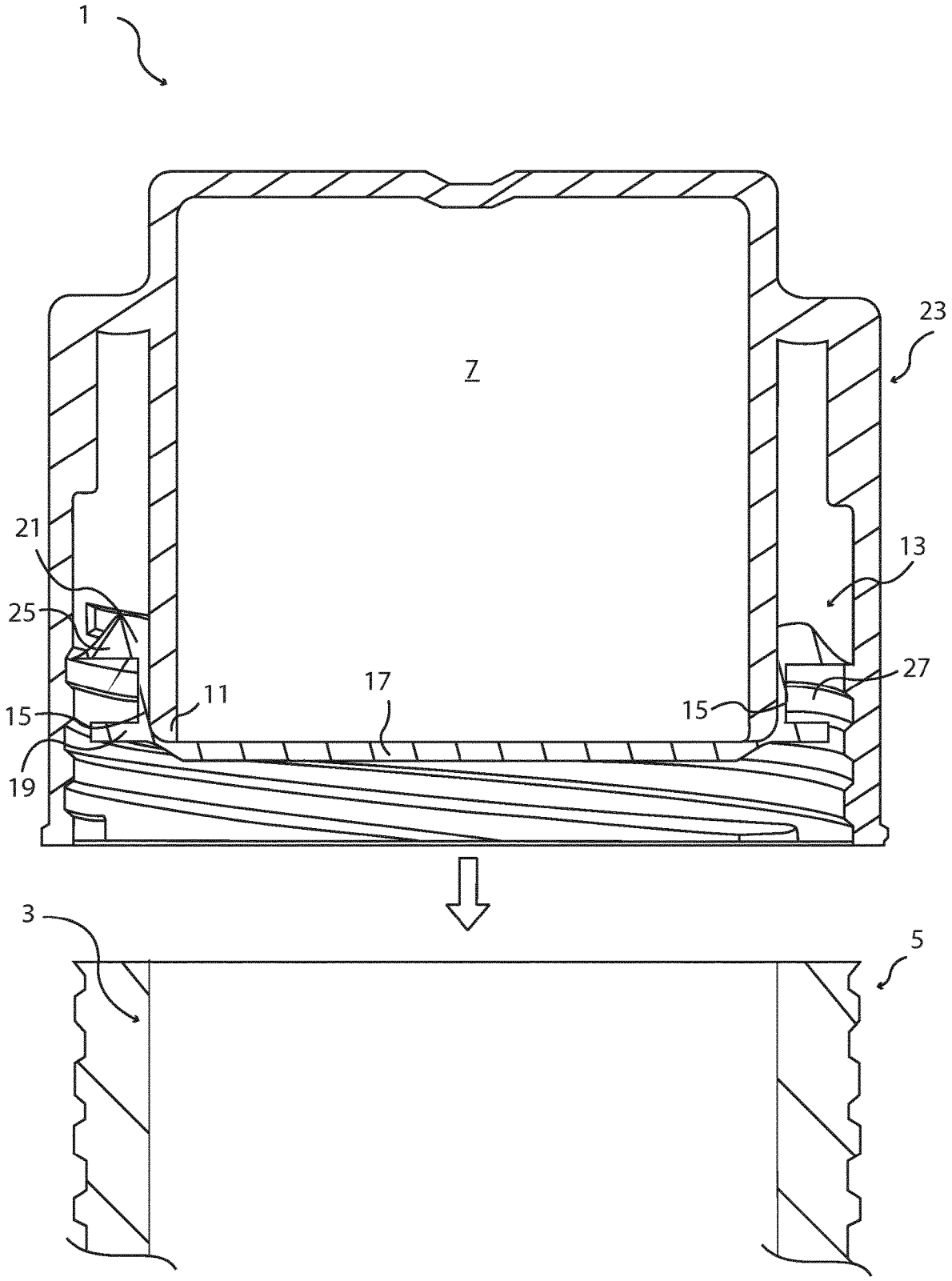
FIG. 1 shows a sectional view of a cartridge according to a particular embodiment in a position ready for use and mounted on a container.

Reference is made to FIG. 1, wherein a cartridge 1 according to an embodiment of the invention is depicted, said cartridge 1 is suitable to be mounted on and to cooperate with the neck 3 of a container 5 in order to allow a product contained in the cartridge 1 to flow out into said container 5. The cartridge 1 comprises a reservoir 7 which is suitable to contain a product, such as, for example, a fluid or a powder. When said cartridge is arranged on the neck 3 of a container 5, it allows the fluid product or the powder to flow out into said container 5. The container 5 is preferably filled with a liquid, thus that the product and the liquid form a solution. In a preferred embodiment, the cartridge comprises means to be screwed on the neck of the container allowing the possibility to safely shake the assembly formed by the cartridge and the container in order to mix the product and the liquid. The user can later have access to the solution by removing the cartridge from the neck of the container.

According to a preferred embodiment, the product flows out from the reservoir 7 into the interior of the container 5 as a result of gravity. As an alternative to this, the reservoir 7 can be a flexible material which is suitable to be compressed in order to force the product to flow out from the reservoir 7 into the container 5, for example through a valve produced in a resilient material.

In a preferred embodiment, the reservoir 7 has a lower opening 9 on its lower wall 11 to transfer the product from the reservoir 7 into the container 5. Preferably, the reservoir 7 forms a tube, and the lower opening 9 of said reservoir is an aperture of the same diameter than said reservoir 7. Thus, the reservoir 7 is a tube opened on one side. In a variant of the invention, the lower wall of the reservoir forms a bottleneck having a diameter smaller than the diameter of the upper wall of the reservoir.

In a preferred variant of the present invention, the cartridge 1 comprises a movable means 13 for sealingly closing the reservoir 7 that comprises at least one or a plurality of movable flaps 17. In a preferred manner, said movable means 13 for sealingly closing can control the closing and the opening of the reservoir 7 in a reversible and reproducible manner. In a disposable version of the present cartridge, the movable means 13 are no longer able to serve to re-close the reservoir 7 once the one or more flaps have been opened.

Thus, according to this embodiment of the invention, the cartridge 1 comprises moveable sealing means 13 to close the opening 9 of the reservoir 7. The moveable sealing means 13 comprises a cylindrical body 15 and one or more flaps 17 closing one the lower aperture of the cylindrical body 15. The cylindrical body 15 is dimensioned to surround the lower wall 11 of the reservoir 7 and to slide along it between a closing and an opening position. In the closing position, the one or more flap 17 close the lower aperture 9 of the reservoir. In the opening position, the one or more flaps 17 are opened by the pressure exerted by the lower wall of the reservoir on said flaps 17, and the distal end of the lower wall 11 of the reservoir passes through the cylindrical body 15 of the movable sealing means. The moveable sealing means 13 further comprises at least one ring (19, 21) configured to cooperate with the neck 3 of the container 5 in order to allow the moveable sealing means 13 to slide along the lower wall 11 of the reservoir by the pressure exerted on said ring (19, 21) by the neck 3 of the container 5 thereby causing the opening of the one or more flaps 17.

Figure 2A:
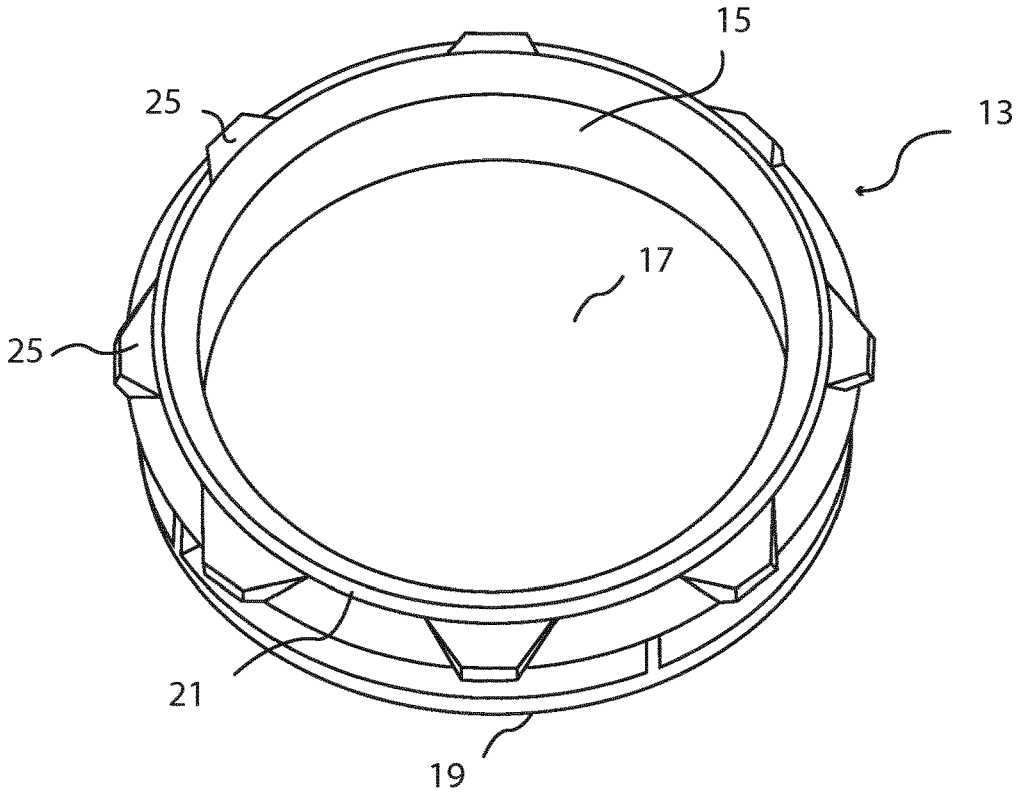
FIGS. 2*a* and 2*b* show respectively a lower and an upper view of the movable sealing means according to a particular embodiment of the invention, wherein the cartridge has a single flap.
Figure 2B:
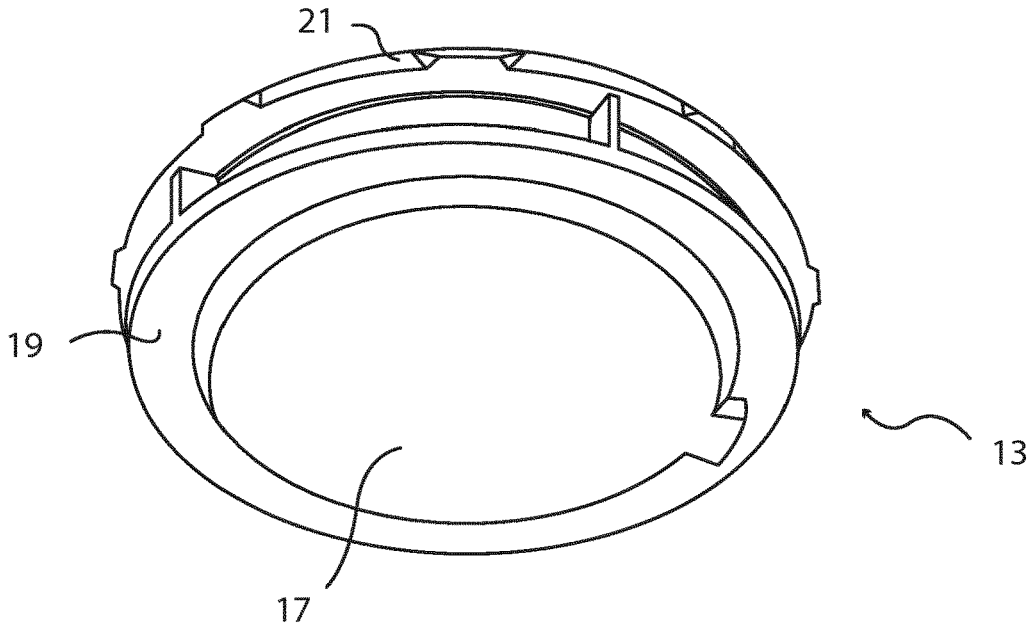

In a preferred embodiment of the invention, and as depicted on FIGS. 2*a* and 2*b*, the movable sealing means 13 comprise two rings (19, 21) distributed along the cylindrical body 15 so as to show a lower ring 19 and an upper ring 21, wherein the lower ring 19 is the one arranged to cooperate with the neck of the container.

In an embodiment, not represented, the moveable sealing means comprise clipping means cooperating with complementary clipping means on the wall of the reservoir in order to be maintained in position for closing the opening of the reservoir. In such a case, it is understood that the clipping means are broken when a pressure is exerted on the ring of the movable sealing means in order to allow it to slide along the reservoir so as to open the one or more flaps. In this embodiment, it is preferred that the movable sealing means have only one ring.

In an embodiment, the cartridge 1 has a socket 23 arranged to surround both the lower wall 11 of the reservoir 7 and the movable sealing means 13. The socket shows a lower aperture dimensioned to receive the neck 3 of the container 5. As it can be seen in FIGS. 1 and 3, the lower aperture has an internal diameter greater than the external diameter of the ring 19, or of at least one of the rings (19, 21), of the movable sealing means 13. When the socket comprises an internal thread 27, the internal diameter of the socket 23 is reduced by said internal thread 27. When the movable sealing means comprises only one ring, this ring has an external diameter lower than the internal diameter of the socket. In such a case, the ring, which is the ring configured to cooperate with the neck of the container, preferably further shows holding lugs configured to cooperate with an internal thread of the socket, or with clipping means inside the socket, in order to maintain the moveable sealing means in position inside the socket, closing the opening of the reservoir.

When the movable sealing means comprise two rings (19, 21) at least the lower ring 19 has an external diameter lower than the internal diameter of the socket 23. Preferably both the upper 21 and the lower ring 19 have an external diameter lower than the internal diameter of the socket 23. This allows the moveable sealing means 13 to move inside the socket 23.

When the movable sealing means 13 comprise two rings (19, 21), the upper ring 21 preferably comprises holding lugs 25 configured to cooperate with an internal thread 27 of the socket 23 in order to maintain the moveable sealing means 13 in position inside the socket 23, closing the opening 9 of the reservoir 7. Preferably, the holding lugs 25 are laid on the top of the internal thread 27 of the socket 23 in order not to be retained by the thread 27 when the movable sealing means 13 is sliding along the reservoir. In such an embodiment, it is understood that the cartridge 1 can be screwed on the neck 3 of the container 5, the internal thread of the socket cooperating with the external thread of the neck of the container.

In a variant of the invention (not represented), the upper ring of the movable sealing means comprises holding lugs configured to cooperate with one or more internal hoops (i.e. clipping means) inside the socket in order to maintain the moveable sealing means in position inside the socket, closing the opening of the reservoir. In such an embodiment, it is understood that the cartridge can be press on the neck of the container in order to be opened. Preferably the ring or one of the rings that is configured to cooperate with the neck of the container has an outer diameter of at least twice the diameter of the opening of the reservoir in order to allow the cartridge to be opened by cooperation with necks of different diameters.

In both cases, the neck is put in contact with the lower ring of the movable sealing means 13 and the screwing or the pressing of the cartridge causes the entry of the neck deeper into the cartridge thereby exerting a pressure on the lower ring 19 of the movable sealing means 13. The moveable sealing means 13 is forced to slide along the wall of the reservoir causing the distal end of the lower wall of the reservoir to pass through the moveable sealing means 13, by the rupture of weakened lines forming a frangible zone on the one or more flaps 17.

Optionally, in order to assist the rupture of the weakened lines forming frangible zone on the one or more flaps, the lower wall of the reservoir shows a bevelled or twisted shape so that its periphery, that is intended to come into contact with the one or more flaps, shows a variation in height with respect to the top of the reservoir.

As said earlier, the moveable sealing means may comprise a single flap or a plurality of flaps. In an embodiment (not represented), the moveable sealing means comprises a plurality of flaps each flap having at least one side in common with an adjacent flap and whose distal ends form a point or line of junction to said plurality of flaps and the lower wall of the reservoir will exert a pressure on the proximal end of the flaps so as to open them when the movable sealing means slide along said lower wall. The distal end of the lower wall of the reservoir is in contact with the proximal end of the flaps so as to activate the opening of the movable sealing means. Weakened lines are arranged on the sides of the flaps and break under the effect of the pressure. The flaps will carry out a rotational movement with respect to their initial positions so that once the reservoir has been opened, the flaps will be arranged parallel to the lower wall of the reservoir.

In a preferred embodiment, the movable sealing means 13 comprise a single flap 17. The flap is connected to the lower ring by a frangible zone defining a perimeter of rupture, suitable to be ruptured by a pressure exerted by the lower wall of the reservoir so as to open it when the movable means slide along said lower wall, and the flap and the lower ring are made of the same material, the frangible zone being obtained by reducing the thickness of the wall of the flap. Preferably, the flap is further connected to the lower ring by at least one hinge in a form of a leg showing a thickness portion.

In a preferred manner, even after opening of the movable sealing means 13, the one or more flaps 17 remain connected to the lower ring 19 of the movable sealing means 13 by means of their proximal end when the movable sealing means comprises a plurality of flap, and by means of the hinge when the movable sealing means 13 comprises a single flap 17. Thus, no fragments can contaminate the solution in the container.

The cartridge according to a particular embodiment of the invention not shown can comprise a second opening on the top of the reservoir. The second opening of the reservoir can be closed by a removable cover. The cover can cooperate with the upper walls of the reservoir by fixing means known to the person skilled in the art, for example a system of notches, or tapping, or threading or soldering.

Figure 3:
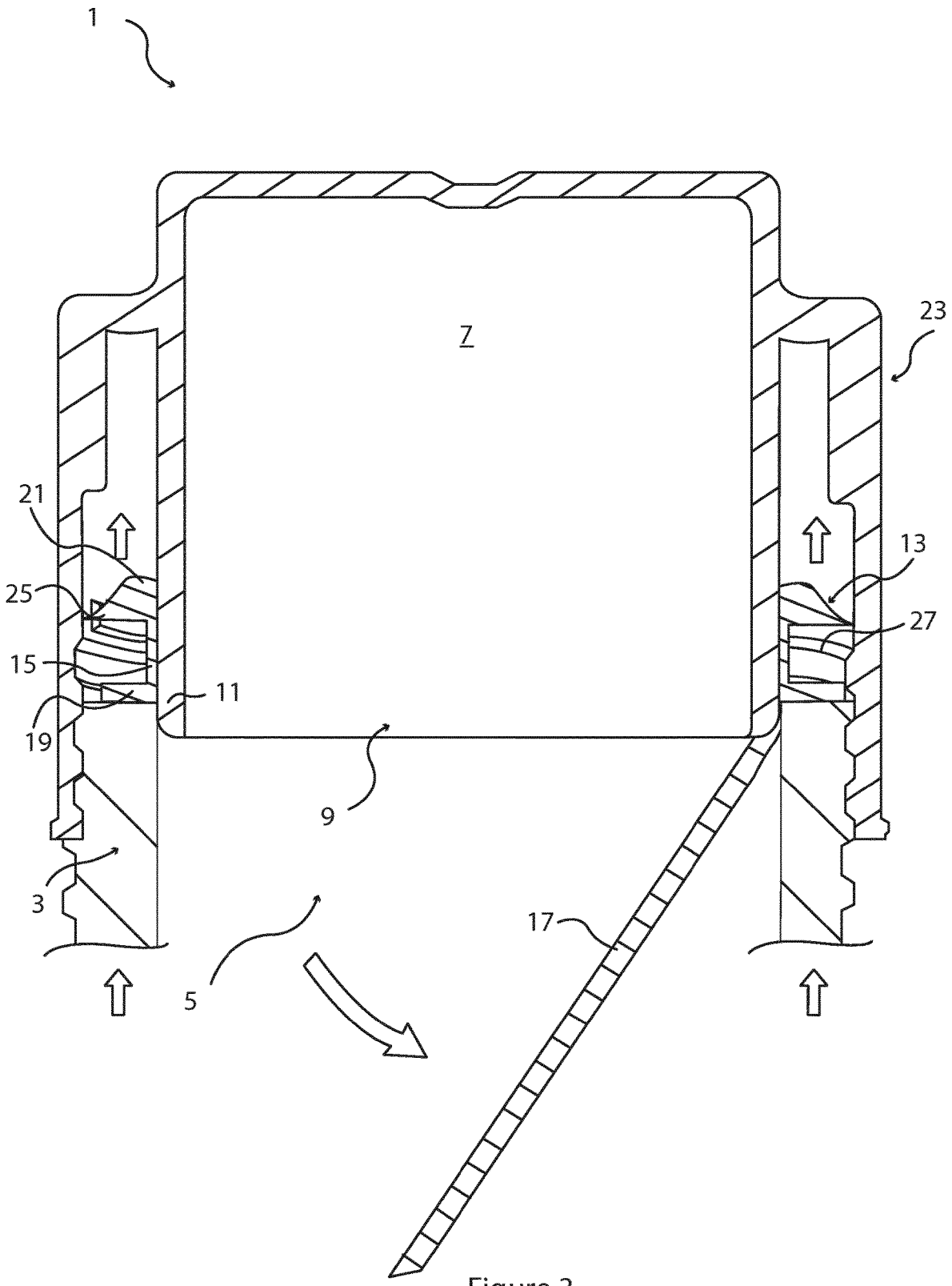
FIG. 3 shows a sectional view of a cartridge according to a particular embodiment in a position after use (i.e. after the moveable sealing means has been opened).

FIG. 3 shows a sectional view of a cartridge according to an embodiment of the invention in its opened position, i.e. after the opening of the movable sealing means 13. The respective displacement of the lower wall 11 of the reservoir 7 through the movable sealing means 13 has allowed the frangible zone arranged in the periphery of the flap 17 to break. The flap 17 cooperates with the lower wall 11 of the reservoir 7. The hinge of the flap 17 nevertheless remains connected to the lower ring 19 of the movable sealing means 13.

The cartridge can be produced by moulding a plastic material. As an alternative to this, constituent elements of the cartridge can be in aluminium, soft steel, cardboard or any other material. In a preferred manner, only the outside surface of the cartridge is in the said materials whilst the movable sealing means 13 is of plastics material.

The variants discussed in the present application are particularly adapted to applications in the food or non-food area.

The cartridge of some embodiments of the present invention provides the advantage of allowing the preparation in situ of a liquid composition (solution or dispersion) under the best conditions of hygiene. The reservoir 7 can contain, apart from pharmaceutical components and food complements, food quality products suitable to be consumed in the liquid form by mixing the said product with a liquid contained in the container 5. As an alternative to this, the product contained in the reservoir 7 can be non-food, for example a care product, a cleaning product or a cosmetic product. In said case, the tightness of the cartridge 1, and particularly of the movable sealing means 13, allows the product to be conserved shielded from the atmosphere and the deterioration is thereof avoided. If the product contained in the reservoir 7 is in concentrated form, thus presenting a risk for the user, embodiments of the present invention will allow the preparation of a diluted solution without risk of contact. The diluted solution formed could be used without any particular precaution.

The invention claimed is:

1. A cartridge which cooperates with a neck of a container to allow a product contained in the cartridge to flow into said container, said cartridge comprising:

a reservoir containing the product, said reservoir having a lower opening and a lower wall;

a moveable sealer comprising a cylindrical body and a flap closing the lower opening of the reservoir, wherein said cylindrical body is dimensioned to surround the lower wall of the reservoir and to slide along said lower wall to define a closed position and an opening position of the reservoir, wherein in the opening position the flap is opened by pressure exerted by the lower wall of the reservoir on said flap; and a socket surrounding both the lower wall of the reservoir and the movable sealer, said socket comprising an internal relief;

wherein the moveable sealer further comprises two rings distributed along the cylindrical body, wherein the two rings comprise a lower ring and an upper ring, said lower ring configured to cooperate with the neck of the container, wherein the neck contacts and exerts pressure on said lower ring to slide the cylindrical body along the lower wall of the reservoir to open the flap, and the upper ring comprising holding lugs configured to cooperate with the internal relief of the socket in order to maintain the moveable sealer inside the socket.

2. The cartridge according to claim 1, wherein the flap is integral with the lower ring.

3. The cartridge according to claim 1, wherein the socket comprises a lower aperture dimensioned to receive the neck of the container and said lower aperture has a diameter greater than individual diameters of both the upper and lower ring.

4. The cartridge according to claim 1, wherein the internal relief is an internal thread.

5. The cartridge according to claim 1, wherein the flap is integrally connected to the lower ring by a frangible zone of reduced thickness defining a perimeter of rupture between the flap and the lower ring.

6. The cartridge according to claim 5, wherein a non-frangible hinge connects the flap to the lower ring.

* * * * *